United States Patent [19]

Mueller et al.

[11] Patent Number: 4,709,636

[45] Date of Patent: Dec. 1, 1987

[54] PROPELLANT CHARGE CASING

[75] Inventors: Dietmar Mueller, Karlsruhe; Karlheinz Reinelt, Hermannsburg, both of Fed. Rep. of Germany

[73] Assignee: Rheinmetall GmbH, Duesseldorf, Fed. Rep. of Germany

[21] Appl. No.: 653,675

[22] Filed: Sep. 21, 1984

[30] Foreign Application Priority Data

Sep. 21, 1983 [DE] Fed. Rep. of Germany ..... 3334026

[51] Int. Cl.[4] ..... F42B 5/18

[52] U.S. Cl. ..... 102/431; 102/443; 102/282

[58] Field of Search ..... 102/431, 433, 465, 466, 102/282

[56] References Cited

U.S. PATENT DOCUMENTS

| | | | |
|---|---|---|---|
| 2,083,665 | 6/1937 | Piphl et al. | 102/431 |
| 2,918,868 | 12/1959 | Ringdal | 102/466 |
| 3,095,813 | 7/1963 | Lipinski | 102/465 |
| 3,397,637 | 8/1968 | Bobinski et al. | 102/431 |
| 3,696,748 | 10/1972 | Picard et al. | 102/431 |
| 3,703,868 | 11/1972 | Braak | 102/431 |
| 3,718,089 | 2/1973 | Wiese | 102/433 |

*Primary Examiner*—Deborah L. Kyle
*Assistant Examiner*—T. J. Wallen

[57] ABSTRACT

The invention relates to a combustible propellant charge casing particularly useful for cartridge ammunition.

In order to simplify the manufacture of ammunition and to improve its storage capacity, a propellant charge casing made from a synthetic foil is provided. The invention achieves particularly advantageous mechanical strength and stability in the propellant charge structure when the casing is formed from a shrinking foil.

9 Claims, 4 Drawing Figures

PROPELLANT CHARGE CASING

BACKGROUND OF THE INVENTION

It is well recognized in the art of propellant charge casings that reducing the deadload component is desireable, particularly in cartridged ammunition. One arrangement for doing so is disclosed in U.S. Pat. No. 2,991,168, wherein the ammunition propellant charge casing is at least partially made out of a combustible material. In contradistinction to conventional propellant charge casings, which are made completely of metal, this state-of-the-art casing has a metallic component which is at most the cartridge casing bottom, a reusable part of the casing. However, the manufacture of a combustible casing part involves many steps and is quite complex and expensive. Moreover, the partially combustible casing material has an unsatisfactory mechanical strength.

SUMMARY OF THE INVENTION

It is an object of this invention to provide a partially combustible propellant charge casing of superior mechanical strength which can be manufactured in a simple and inexpensive manner, with a resulting improvement in the handling of the propellant charge, and cartridged ammunition in particular.

BRIEF DESCRIPTION OF THE DRAWING

The cartridge casing of this invention is more clearly illustrated and described in the accompanying drawings, wherein.

DETAILED DESCRIPTION

Figure 1:
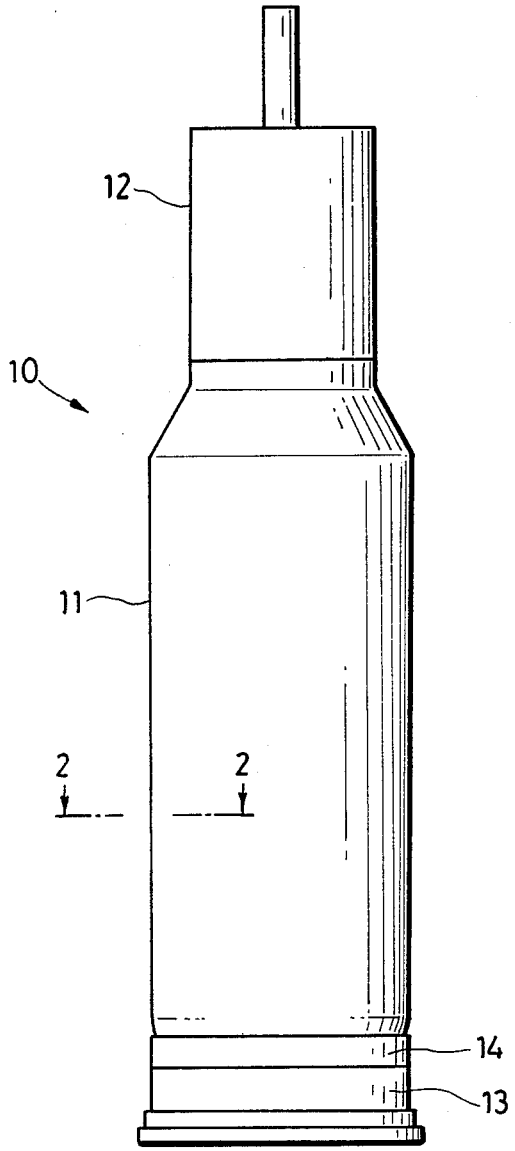
FIG. 1 is a side-elevational view of cartridged ammunition of a large caliber.
Figure 2:
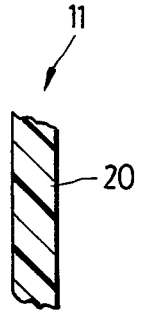
FIG. 2 is a cross-sectional view through a portion of the propellant charge casing.

FIG. 1 illustrates schematically in side elevation a large-caliber cartridged ammunition unit 10 in which a projectile 12 is mounted. The cartridge ammunition unit 10 has a metallic bottom 13 and a combustible casing 11, as well as a packing ring 14 made out of an elastic material. In accordance with the invention the propellant charge casing 11 is made of a combustible synthetic foil 20 which houses the propellant charge powder (not illustrated in FIG. 1) and which is firmly connected on the one hand with the projectile 12 and on the other hand with the cartridge casing metallic bottom 13.

According to the invention, synthetic foil materials which include oxygen carriers are particularly suitable for the propellant charge casing. These can be adjusted to achieve desired combustion charateristics.

Suitable synthetic foil materials include, for example, polyethelene, polyurethane, polyisobutalene, polyuntadene, and polysulphides.

Suitable oxygen carriers include lithium nitrate, lithium chlorate, sodium nitrate, sodium perchlorate, potassium nitrate, potassium perchlorate, ammonium nitrate, ammonium perchlorate, ammonium chlorate, hydrazine nitrate, nitrile perchlorate, hexanitroethane, and organic peroxide, in particular dibenzoperoxide.

Combined oxygen carriers are also particularly suitable for the propellant charge casing. These include boron-potassium nitrate, zirconium barium nitrate, and mixtures of magnesium, boron, and/or aluminum with the afore-mentioned oxygen carriers.

The afore-mentioned organic peroxides and the combined oxygen carriers can form up to 50% of the synthetic foil material, with a prefered range of 10 to 20%.

In a particularly advantageous embodiment, the synthetic foil 20 is designed to shrink under the influence of heat, to strongly compress the propellant charge powder contained therein. In this manner a superior mechanical strength of the entire propellant charge structure is achieved. In comparison to a conventional loosely filled powder, a considerably higher load density is achieved, which provides inner ballistic advantages.

In another embodiment, a method of manufacture conventional in the food packaging industry is employed. The propellant charge powder is sheathed or encased within the synthetic foil 20 by using a vacuum pump to evacuate air from the foil housing. This causes the synthetic foil 20 to adhere strongly to the encased propellant charge powder. The result is a stable structure similar to that achieved by a shrinking foil.

A third embodiment provides for compression of the propellant charge powder within the propellant charge casing 11, formed from synthetic foil 20. The propellant charge casing 11 is placed in a press, and the walls of the casing bear against the inner walls of the press during the filling process. This method of manufacture again achieves a high load density coupled with improved mechanical stability of the propellant charge structure.

Figure 3:
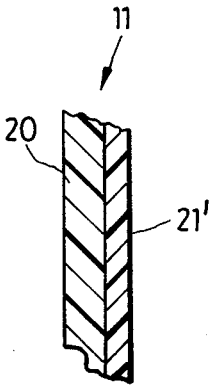
FIG. 3 is a cross-sectional view through a further embodiment of a propellant charge casing in accordance with the invention.

A fourth embodiment provides for an additional increase in the stability of the propellant charge casing. As shown in FIG. 3, the synthetic foil material 20 can be formed with a propellant charge casing which has an outer layer 21' made of polyurethane. The combustibility of outer layer 21' can be increased by addition of boron-potassium nitrate, or another of the above-described oxygen carriers.

Although the invention has been primarily described in conjunction with large-caliber cartridged ammunition, it is also possible to utilize the invention with equal success and corresponding cost savings in small-caliber ammunition, and for encasing propellant charges for use with artillery projectiles.

The selection of foil materials that are gas and moisture impermeable provides and increase in the storage capability of a propellant charge encased according to the invention. In addition, a number of very simple and inexpensive methods of manufacture are afforded by the invention.

Transparent or partially transparent foil materials may be used, so that the condition of the prepared propellant charge may be examined prior to use, without destroying the propellant charge casing.

In a fifth embodiment, the cartridged ammunition (FIG. 1) is provided with a propellant charge casingn 11 formed from synthetic foil 20. The foil is in the form of a flexible hose, fastened at one end to the tail of the projectile 12 and at the other end to the metallic casing bottom 13. The foil hose is preferably fastened by a glued or welded joint. In certain casings the hose may be joined by a threaded connection, a sprayed adhesive material, or by a shrink fit of the foil. It is also possible to simultaneously fasten the foil 20 to the casing bottom 13 and mount the packing ring 14, after which the propellant charge can be transferred into the propellant charge casing 11.

Pourable powder can advantageously be poured into the propellant charge casing via an opening in the cartridge bottom 13, which opening serves to accommodate therein the propellant charge fuse. Pipe-powder is loaded into propellant charge casing 11 prior to securing the casing bottom 13, and the propellant charge casing 11 is thereafter shrunk or evacuated. During evacuation, the opening for the propellant charge fuse can be used to suck out the air.

Conventional metal propellant charge casings have a regular surface. In contrast, the present heat shrunk or evacutaed finished synthetic casings have a strongly irregular outer surface. This provides an inner-ballistic advantage, because surface irregularities facilitate combustion of the foil.

Figure 4:
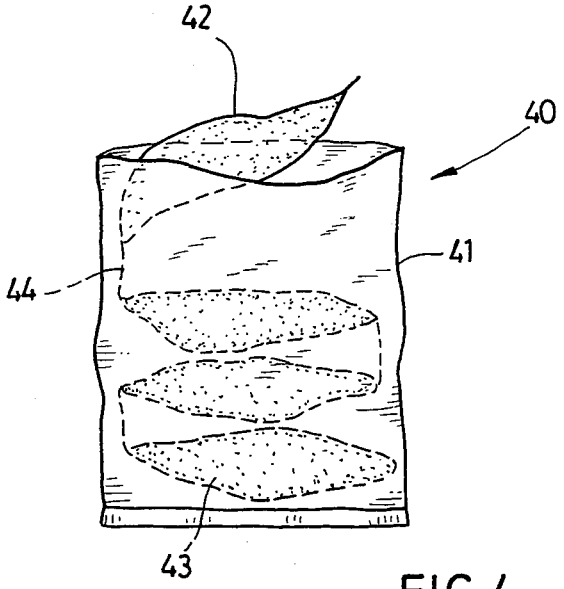
FIG. 4 is a schematic view in elevation through a propellant charge which is in the form of a module.

A sixth embodiment of the invention is shown in FIG. 4. In this embodiment, the propellant charge 40 is constructed in a module-like form, with plurality of propellant charge portions 43 separated from each other and disposed within a shrinkable hose 42. The separate propellant charge portions 43 are linked by connecting sheet material 4, and they are all disposed within a synthetic foil hose 41. According to need, some or all of the separate propellant charges 43 may be used in the casing. For this purpose the outer sheath 41 can be easily torn, so that a preselected number of unneeded propellant charges 43 are removed. Perforations are provided in order to facilitate separation of the connecting sheet material 44 and the foil casing.

In order to facilitate the manipulation of the separate propellant charges, and in particular to obtaining a preselected propellant charge mass, the separate propellant charges 43 encased in hose 42 can be color coded or marked with printing, as by setting forth the number of portions.

It is, of course, also possible to provide the separate propellant charges 43 in a propellant charge casing with a synthetic foil adapted to the shape of the propellant charge chamber, in a manner analogous to that described with reference to the cartridged ammunition of FIG. 1. The simplest way to achieve this result is to position the foil in a loading chamber of a particular shape for the filling process.

Although the invention is described according to a limited number of embodiments illustrated by accompanying drawings, it will be understood by those skilled in the art that these examples do not serve to limit the scope of the invention. Changes in characteristics such as the relative dimensions of the parts, the materials used, and the suggested manner of use of the invention may all be made herein, without departing from the spirit and scope of the invention. We clain:

We claim

1. An improved propellant charge casing for holding propellant charge powder in cartridge or artillery ammunition, wherein the propellant charge casing comprises an inner and an outer layer of synthetic foil material, said synthetic foil material is shrinkable at least one of said layers further comprises a mixture of at least one metal selected from the group consisting of magnesium boron and aluminum and at least one of the group consisting of lithium nitrate, lithium chlorate, sodium nitrate, sodium perchlorate, potassium nitrate, potassium perchlorate, ammonium nitrate, ammonium perchlorate, ammonium chlorate, hydrazine nitrate, organic peroxides, nitrile perchlorate, hexanitroethane, boron-potassium nitrate and zirconium barium nitrate.

2. An improved propellant charge casing as in claim 1, wherein the outer layer of shrinking foil made from polyurethane.

3. An improved propellant charge casing as in claim 2, wherein the inner layer of said shrinking foil material is at least partially transparent.

4. An improved propellant charge casing as in claim 3, wherein said shrinking foil material is selected from at least one of the group consisting of polyethylene, polyurethane, polyisobutylene, polybutadiene, and polysulfide.

5. An improved propellant charge casing as in claim 4, wherein at least one layer of synthetic foil material contains a maximum of 50 percent of oxygen carriers.

6. An improved propellant charge casing as in claim 5, wherein at least one layer of synthetic foil material contains 10–20 percent of oxygen carriers.

7. An improved propellant charge casing as in claim 5, further comprising propellant charge divided into a plurality of propellant charge portions by the synthetic foil material arranged in the form of a shrinkable hose divided into a plurality of discrete compartments, which compartments are joined to each other by synthetic foil webs, each one of the propellant charge portions being disposed within and encased by one of the compartments, the web portions having breaking zones which can be easily severed.

8. An improved propellant charge casing as in claim 7, wherein the plurality of encased propellant charge portions are disposed in a second undivided hose of synthetic foil material.

9. An improved propellant charge casing as in claim 7, wherein the shrinkable hose includes indicia means for identifying the propellant charge portions contained therein.

* * * * *